US006612717B2

(12) United States Patent
Yen

(10) Patent No.: US 6,612,717 B2
(45) Date of Patent: Sep. 2, 2003

(54) HIGH EFFICIENT TUBULAR LIGHT EMITTING CYLINDER

(76) Inventor: George Yen, 2F, 15, Alley 11, Lane 327, Sec. 2, Chung Sun Rd., Chung Ho Taipei (TW)

( * ) Notice: Subject to any disclaimer, the term of this patent is extended or adjusted under 35 U.S.C. 154(b) by 0 days.

(21) Appl. No.: 09/929,011

(22) Filed: Aug. 15, 2001

(65) Prior Publication Data

US 2002/0196623 A1 Dec. 26, 2002

(30) Foreign Application Priority Data

Jun. 21, 2001 (TW) ..... 90210452 U

(51) Int. Cl.[7] ..... F21V 5/00

(52) U.S. Cl. ..... 362/245; 362/800; 362/555; 362/219; 362/218; 362/232; 362/239

(58) Field of Search ..... 362/555, 580, 362/800, 219, 218, 221, 222, 232, 326, 238, 239, 250, 235, 236, 237, 240, 246, 247, 248, 249, 245

(56) References Cited

U.S. PATENT DOCUMENTS 4,999,755 A * 3/1991 Lin ..... 362/250
5,081,568 A * 1/1992 Dong et al. ..... 362/184
5,257,049 A * 10/1993 Van Peteghem ..... 346/107
5,490,049 A * 2/1996 Montalan et al. ..... 362/240
5,506,760 A * 4/1996 Giebler et al. ..... 362/249
5,622,423 A * 4/1997 Lee ..... 362/186
6,045,240 A * 4/2000 Hochstein ..... 362/294
6,472,823 B2 * 10/2002 Yen ..... 315/112

* cited by examiner

*Primary Examiner*—Stephen Husar
*Assistant Examiner*—Sharon Payne
(74) *Attorney, Agent, or Firm*—Troxell Law Office PLLC

(57) ABSTRACT

A high efficient tubular light emitting cylinder is disclosed. The high efficient tubular light emitting cylinder is especially an LED tubular light emitting cylinder which can be installed and maintained easily and has a high light emitting efficiency. The tubular light emitting cylinder has a plurality of light emitting segments. The light emitting segments are connected in series. The connected light emitting segments are installed in a tubular light emitting cylinder for improving the light emitting efficiency. The light emitting segments can be taken out from the light emitting cylinder easily so that the light emitting cylinder can be installed and maintained easily and conveniently.

1 Claim, 2 Drawing Sheets

HIGH EFFICIENT TUBULAR LIGHT EMITTING CYLINDER

FIELD OF THE INVENTION

The present invention relates to a light source, and particularly to a highly efficient tubular light emitting cylinder having a uniform light emitting surface and smooth light.

BACKGROUND OF THE INVENTION

Conventionally, a tubular light emitting device is a special lamp device. As illustrated in FIGS. 1A and 1B, a prior art product is shown. In the prior art, a point light source (bulb) (105) is installed at one or two ends of a tubular light emitting cylinder 101 that has reflecting layers 103 and 104, light mixing layer 106 and diffusing layer 102 in the cylinder. The point light source will generate a soft and smooth plane light source. Since the light source 105 is arranged at one or both ends of a tubular light emitting cylinder 101, as described above, the conventional tubular light emitting cylinder is conveniently repairable.

As shown in the figures, 1Lx is incident light, 1Rx is reflective light and 1Tx is transmitting light. Since the conventional light source is too hot, the materials in the light emitting cylinder change their quality over time (about through one year). Therefore, in some recent products, LEDs are used as a light source, but the light emitting efficiency is low. Referring to FIGS. 1A and 1B, light source 105 emits light that is reflected many times and then transmitted out of the light emitting cylinder. In this process, a large amount of light is lost. Furthermore, since the transmitting direction of the light source has an angle of about 180 degrees with the light emitting surface. It is apparent that the light emitting efficiency is low.

SUMMARY OF THE INVENTION

Accordingly, the primary object of the present invention is to provide a highly efficient tubular light emitting cylinder, wherein a light emitting device has an elongated strip body and is installed in the light emitting cylinder so that the light emitting efficiency is about 5 to 10 times of the conventional one. This is because the path of an elongated strip light emitting device is shorter than the prior art and further the number of times of reflection are reduced greatly. Therefore, light efficiency is improved greatly. Therefore, by the diffusing property of a light emitting cylinder, a uniform light emitting surface and smooth light are acquired.

The present invention provides a highly efficient tubular light emitting cylinder. The highly efficient tubular light emitting cylinder is more specifically an LED tubular light emitting cylinder that can be installed and maintained easily and has a high light emitting efficiency. The structure of the tubular light emitting cylinder has a plurality of light emitting segments connected in series. The connected light emitting segments are installed in a tubular light emitting cylinder for improving the light emitting efficiency. The light emitting segments can be taken out from the light emitting cylinder easily so that the light emitting device can be installed and maintained easily and conveniently.

The various objects and advantages of the present invention will be more readily understood from the following detailed description when read in conjunction with the appended drawing.

DETAILED DESCRIPTION OF THE PREFERRED EMBODIMENTS

Figure 1A:
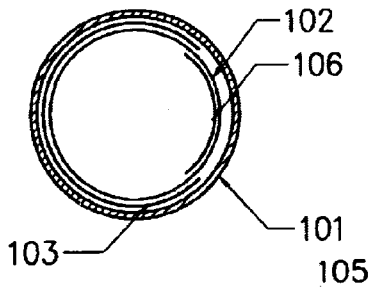
Prior Art Fig. 1A
FIG. 1A is a front view of a conventional tubular light emitting device.
Figure 1B:
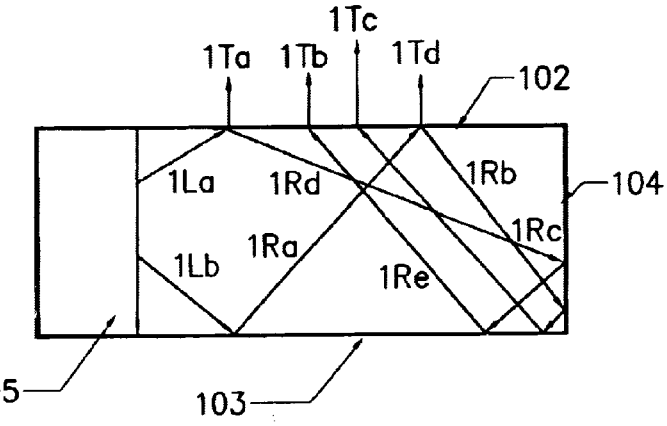
Prior Art Fig. 1B
FIG. 1B is a lateral view of a conventional tubular light emitting device.
Figure 2A:
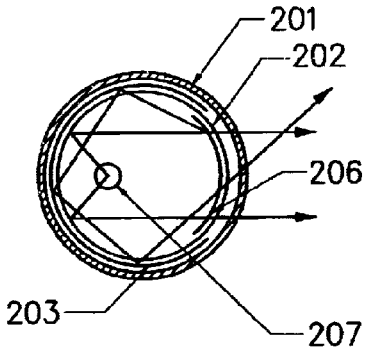
FIG. 2A is a front view of the tubular light emitting cylinder of the present invention.
Figure 2B:
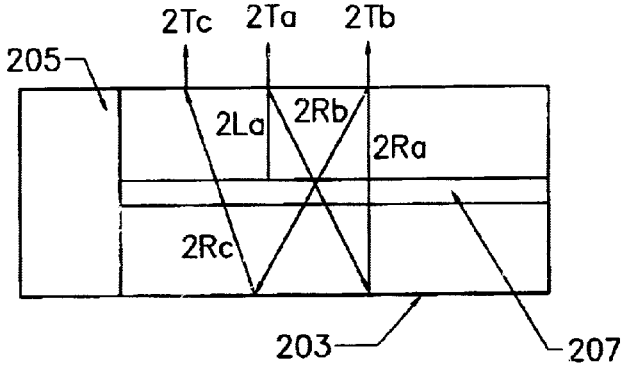
FIG. 2B is a lateral view of the tubular light emitting cylinder of the present invention.

Referring to FIG. 2, in the present invention, strip light sources 207 are arranged in a light emitting cylinder 201 in the same direction. The light emitting cylinder 201 has a diffusing layer 202, a reflecting layer 203, and a light mixing layer 206. Therefore, the light of the strip light source 207 transmits out of the light emitting cylinder 201 with an angle of approximate 90 degrees. The reflection is reduced greatly. For a conventional lateral light source (referring to FIGS. 1A and 1B), light transmits out through the light mixing layer at an angle of approximate 180 degrees. The present invention is more efficient than the prior art. In FIGS. 2A and 2B, the light 2Lx of FIGS. 2A and 2B is incident light, 2Rx is reflective light and 2Tx is transmitting light.

Figure 3:
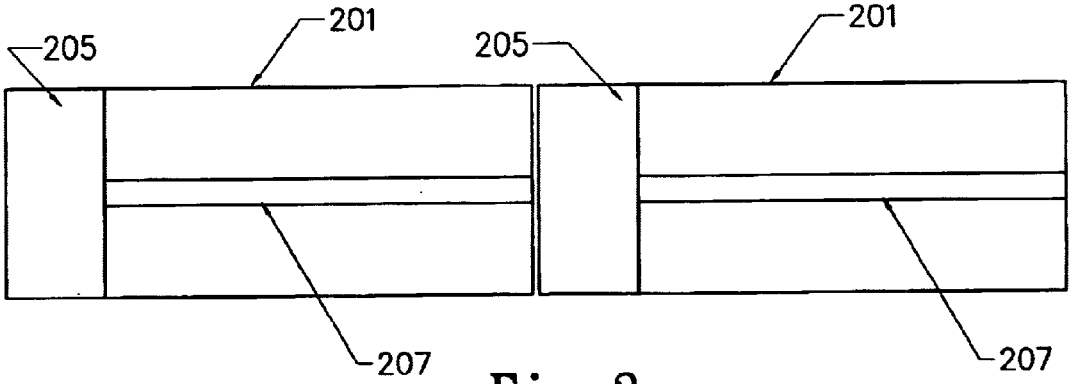
FIG. 3 is a schematic view showing a structure of the tubular light emitting cylinder according to the present invention.

To change light source into a long strip is another problem, since it is desired to update the light source, a large space is necessary from two long cylinders (referring to FIG. 3). Therefore, the feature of an optic long cylinder is unnecessary.

Figure 4:
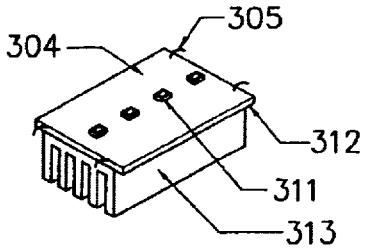
FIG. 4 is a perspective view showing the light emitting segment of the tubular light emitting cylinder in an embodiment of the present invention.
Figure 5:
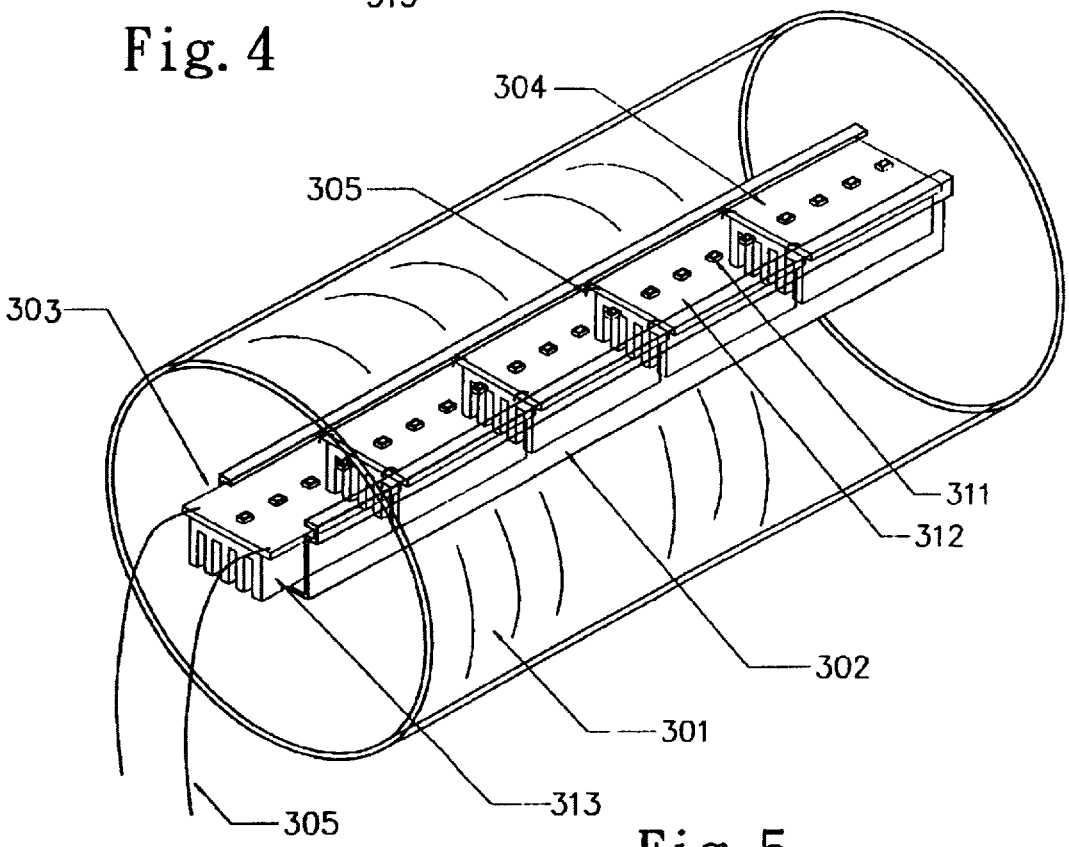
FIG. 5 is a perspective view showing the tubular light emitting cylinder of the embodiment according to the present invention.
Figure 6:
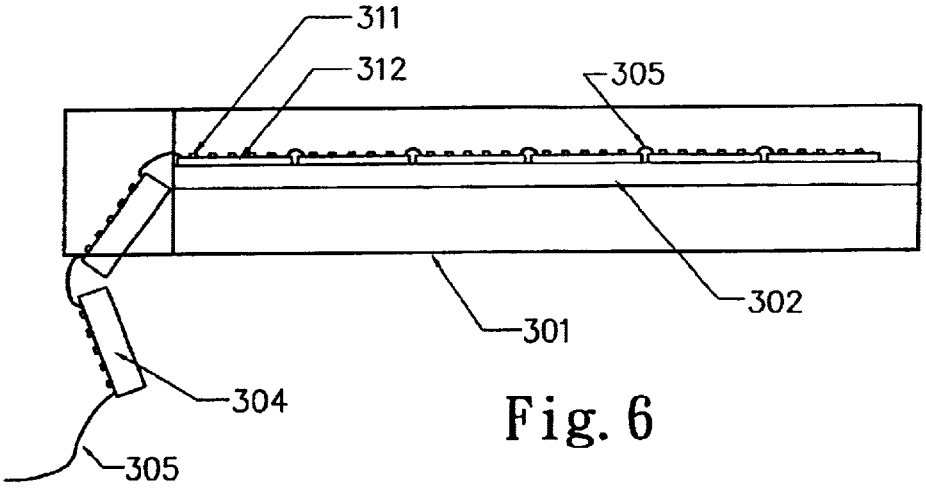
FIG. 6 is a lateral view of the tubular light emitting cylinder in an embodiment of the present invention.

To resolve the problem, the present invention provides a highly efficient tubular light emitting cylinder 301, as illustrated in FIGS. 4, 5 and 6. In this tubular light emitting cylinder, the property of an LED is used. At the side of the light emitting cylinder 301, the light source 303 has a plurality of light emitting segments connected as a long strip by an electric wire 305 or a soft circuit board. Ech light emitting segment has a plurality of LEDs 311 that are installed in a circuit board 312.

The light emitting segment 304 includes a circuit board 312. A back side of the circuit board 312 is formed with a metal heat dissipating device 313 with a plurality of trenches thereon. Further, the light emitting cylinder 301 is formed with a track 302, so that each light emitting segment 304 may easily slide into or out of the light emitting cylinder 301. FIG. 6 is a schematic view showing the operation of installing the present invention.

Of course, a general long strip light source may be assembled by the present invention. However, the LEDs are point sources, so the illumination and emitting angle of each LED are different, but because of the diffusing property of the light emitting cylinder a uniform light emitting area is obtained and a soft light emitting effect is achieved.

As the present invention is thus described, it will be obvious that the same may be varied in many ways. Such variations are not to be regarded as a departure form the spirit and scope of the present invention, and all such modifications as would be obvious to one skilled in the art are intended to be included within the scope of the following claims.

What is claimed is:

1. A highly efficient tubular light emitting cylinder comprising:

a) an elongated light emitting cylinder having a diffusing layer and a reflecting layer;

b) a track located in and extending along a length of the light emitting cylinder;

c) an elongated light strip source positioned in the light emitting cylinder to produce light at an angle of approximately 90 degrees to a surface of the light emitting cylinder, the light strip source having a plurality of light emitting segments slidably mounted in the track along the length of the light emitting cylinder, each light emitting segment has a plurality of LEDs on a circuit board that slidably engages the track, each light emitting segment electrically connected to an adjacent light emitting segment; and d) a metal heat dissipating device having a plurality of trenches mounted on each circuit board and located within the track to dissipate heat from the circuit boards.

* * * * *